United States Patent [19]

Spielvogel et al.

[11] Patent Number: 4,489,643

[45] Date of Patent: Dec. 25, 1984

[54] SAFETY CONTROL DEVICE FOR PROTECTING HYDRAULICALLY SUPPORTED LOADS AGAINST UNCONTROLLED LOWERING AND LIFTING

[75] Inventors: Harry Spielvogel, Dusseldorf; Heinz Schedler, Heidesheim, both of Fed. Rep. of Germany

[73] Assignee: SMS Schloemann-Siemag Aktiengesellschaft, Dusseldorf, Fed. Rep. of Germany

[21] Appl. No.: 226,737

[22] Filed: Jan. 21, 1981

[30] Foreign Application Priority Data

Mar. 8, 1980 [DE] Fed. Rep. of Germany ..... 3008929

[51] Int. Cl.[3] ..... F15B 13/042

[52] U.S. Cl. ..... 91/515; 91/517; 91/518; 91/445

[58] Field of Search ..... 91/445, 517, 518, 515, 91/171

[56] References Cited

U.S. PATENT DOCUMENTS

| | | | |
|---|---|---|---|
| 2,460,774 | 2/1949 | Trautman | 91/515 |
| 3,178,886 | 4/1965 | Watson | 91/445 |
| 3,859,791 | 1/1975 | Allen | 91/433 |
| 3,874,269 | 4/1975 | Walters | 91/433 |
| 3,878,765 | 4/1975 | Walters | 91/433 |
| 3,990,349 | 11/1976 | Valantin | 91/512 |
| 4,028,997 | 6/1977 | Lang | 91/518 |
| 4,052,929 | 10/1977 | Baatrup | 91/433 |
| 4,066,006 | 1/1978 | Heiser | 91/445 |
| 4,091,715 | 5/1978 | Onderka | 91/445 |
| 4,093,092 | 6/1978 | Habiger | 91/512 |
| 4,094,228 | 6/1978 | Schexnayder | 91/512 |
| 4,243,855 | 1/1981 | Gratzmuller | 91/433 |
| 4,286,502 | 9/1981 | Bianchetta | 91/445 |
| 4,341,149 | 7/1982 | Dezelan | 91/445 |
| 4,355,565 | 10/1982 | Bianchetta | 91/445 |

*Primary Examiner*—Abraham Hershkovitz
*Attorney, Agent, or Firm*—Holman & Stern

[57] ABSTRACT

A safety circuit for preventing uncontrolled descent of a hydraulically supported load, in the event of a leak, comprises parallel hydraulic pressure feed lines, control valves in these, and means responsive to a difference in pressure between the lines and arranged to close the valves when such a pressure difference is detected. The valves are provided adjacent to a lifting cylinder or cylinders and close to the pressure source, so as to prevent spillage of hydraulic fluid as well as to prevent descent of the supported load.

9 Claims, 4 Drawing Figures

1
1a
1b
2
3
4
5
6
7
8
9
10
11
12
13
14
15
16
17a
17b
18a
18b
19a
19b
20
22
23a
23b
24
25a
25b
26a
26b
27
28
29
ΔP

SAFETY CONTROL DEVICE FOR PROTECTING HYDRAULICALLY SUPPORTED LOADS AGAINST UNCONTROLLED LOWERING AND LIFTING

This application relates to co-pending application Ser. No. 238,438, filed Feb. 26, 1981 in the names of the same inventors.

BACKGROUND OF THE INVENTION

1. Field of the Invention

The invention relates to a safety control device for protecting hydraulically supported loads against uncontrolled lowering and lifting, for example in vertical presses or other load-supporting devices.

2. Description of the Prior Art

Uncontrolled lowering of hydraulically lifted and supported loads can occur by the bursting of a pipeline subjected to hydraulic or pneumatic pressure. The consequences thereof may be severe damage to the machinery or personnel accidents by falling loads, or contamination of the environment by outflowing pressure liquid.

SUMMARY OF THE INVENTION

It is an object of the invention to provide a device which, for example in the case of vertical presses and forming presses or other loads supported or to be lifted by hydraulic means, prevents the load from descending suddenly in the event of fracture of a pipe, a leakage or the like, and limits to a minimum uncontrolled spillage of pressure liquid in the interest of prevention of contamination of the environment.

According to this invention, valves actuated by pressure difference are arranged switching in mutual dependence between load withdrawal cylinders or support cylinders on the one hand and a source of working pressure on the other hand.

In one embodiment of the invention, for at least two cylinders, for each cylinder two of the valves are provided as controlled non-return valves which are indirectly controlled in a pressure difference dependent manner, and one valve is provided as a directional control valve which is hydraulically maintained in equilibrium in the center position and is directly controlled in a pressure difference dependent manner, wherein the directional control valve is controlled by way of respective branch pipes from two working pressure pipes extending between the source of working pressure and a respective cylinder, each branch pipe being arranged between the two associated non-return valves.

In an advantageous manner, this makes use of the pressure difference which is produced by a fracture of one of the two working pressure pipes, for the purpose of controlling the directional control valve by means of two branch pipes which branch off these working pressure pipes between two controlled non-return valves, the directional control valve being maintained hydraulically in the center position by the two branch pipes under normal pressure conditions in both working pressure pipes. Upon loss of pressure in one of the two branch pipes, the directional control valve is switched and stops the control oil pressure to the controlled non-return valves. This has the effect that at once, by closing of the respective non-return valves, either a cut-off of the working pressure downstream of the source of working pressure or a cut-off of the cylinder supporting the respective load is effected. Thus, if a working pressure pipe becomes defective during lowering or lifting, uncontrolled descent of a load supported by the hydraulic working pressure is prevented.

Alternatively, two of the valves are controlled non-return valves which are controlled indirectly in a pressure difference dependent manner by means of a pressure difference sensor and one valve is a directional control valve which is electro-hydraulically maintained in the rest position in a pressure difference dependent manner controlled by means of a pressure difference sensor, wherein the sensor is connected, for the purpose of electrically switching the directional control valve, to two branch pipes which branch off respective working pressure pipes and which are arranged between the source of working pressure and a respective cylinder, and the branch pipes are located between the non-return valves.

In this second embodiment a pressure difference sensor is provided which actuates an electrical contact in dependence upon a pressure difference occurring between the two working pressure pipes. This contact in turn relieves the control pressure for switching the directional control valve by means of a preceding magnetic valve. Thereby the control pressure to the respective open controlled non-return valves is cut off.

In a further embodiment of the invention a single cylinder operating as a working cylinder or as a support cylinder or lifting cylinder is always associated with two valves which are directly controlled in a pressure difference dependent manner and one valve as a directional control valve hydraulically maintained in equilibrium in the center position which is directly controlled in a pressure difference dependent manner, wherein the directional control valve is controlled by way of a respective branch pipe by two working pressure pipes between the source of working pressure and the cylinder, and the branch pipes are arranged between the controlled non-return valves downstream of the source of working pressure and the non-return valves associated with the cylinder.

In this way, by pressure comparison or pressure difference of the two working pressure pipes, a control valve which is maintained in equilibrium can be displaced from the center equilibrium position and can initiate a corresponding control process which, even in the case of only a single working cylinder or support or lifting cylinder, has the effect of immediate closure of the two respective non-return valves which are controlled in a pressure loaded manner, thereby holding the load or disconnecting the pressure medium from the source of working pressure.

Alternatively, for a single cylinder operating as a working cylinder or as a support or lifting cylinder, two valves are always provided which are indirectly controlled in a pressure difference dependent manner by means of a pressure difference sensor, and one valve is provided as a directional control valve electro-hydraulically maintained in the rest position which is controlled in a pressure difference dependent manner by means of a pressure difference sensor, wherein for the purpose of electrically switching the directional control valve the pressure difference sensor is connected to two branch pipes which branch off respective working pressure pipes and which are arranged between the source of working pressure and the cylinder, and the branch pipes are located between the controlled non-return valves near the source of working pressure and the non-return valves which are associated with the cylinder.

In an advantageous manner the pressure difference sensor is effective in this case as an electrical switch.

In the latter embodiment a pressure difference sensor is provided which, dependent upon the pressure difference between the two working pressure pipes, actuates an electrical contact. Thereby this device which is provided for at least two cylinders as working cylinders or support cylinders is usable also for a single cylinder in the same advantageous manner.

BRIEF DESCRIPTION OF THE DRAWINGS

Embodiments of the invention will be described in detail by way of example only with reference to the accompanying drawings, in which.

DETAILED DESCRIPTION

Figure 1:
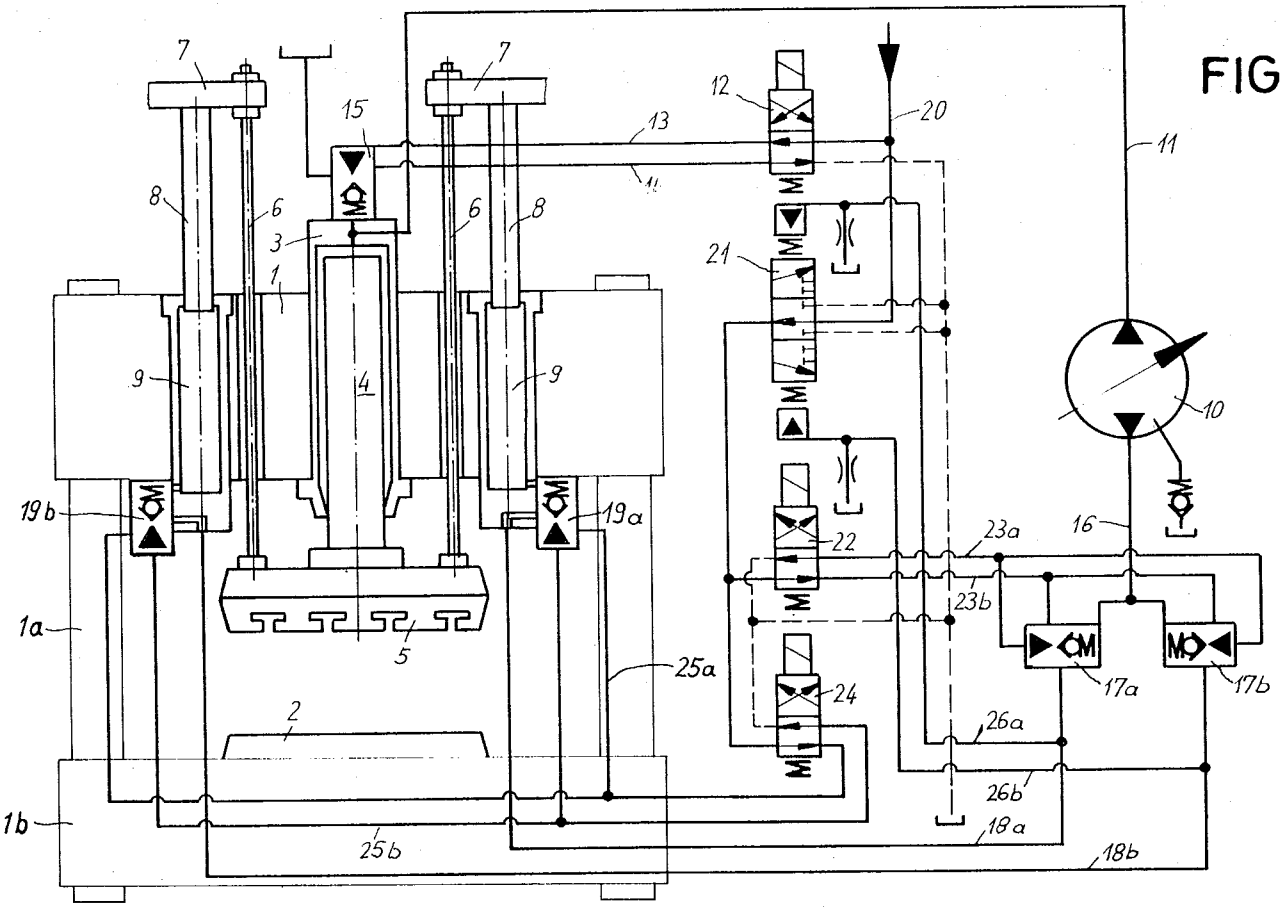
FIG. 1 is a schematic view of a portion of a vertical forming press with a hydraulic circuit controlling the withdrawal movements of the press, with a directly hydraulically controlled directional control valve.

In FIG. 1 an upper cylinder cross-beam 1 of a vertical forming press is connected by tie members 1*a* to a lower cross-beam 1*b* and a press table 2 arranged on the latter. A press piston or press plunger 4, which slides in the main press cylinder 3 located in the cylinder cross-beam 1, is connected at its lower end to a ram or platen 5. Retraction rods 6 are fixed to the ram 5 and extend vertically upwards and are guided in the cylinder cross-beam 1. At their upper ends the two retraction rods 6 are screwed to cross-members 7 which are connected to two retraction plungers 8 parallel to the retraction rods 6. The retraction plungers 8 slide in withdrawal cylinders 9 arranged in the cylinder cross-beam 1.

The main drive of the press plunger 4 is effected by a controllable hydraulic pump 10, connected by way of a working pressure pipe 11. Upon retraction of the press plunger 4 a controlled non-return valve 15 which is arranged at the main press cylinder 3 is opened by way of a solenoid valve 12 and pipes 13, 14, so that the hydraulic fluid in the main press cylinder 3 can flow away into a pressure-free liquid tank.

For withdrawal of the ram 5 to its starting position, the withdrawal cylinders 9 are charged with working pressure produced by the hydraulic pump 10, by way of a pipe 16, two controlled non-return valves 17*a*, 17*b*, and two further working pressure pipes 18*a* and 18*b*. In this case the working pressure is supplied through two further controlled non-return valves 19*a* and 19*b* arranged at the respective withdrawal cylinders 9.

Figure 3:
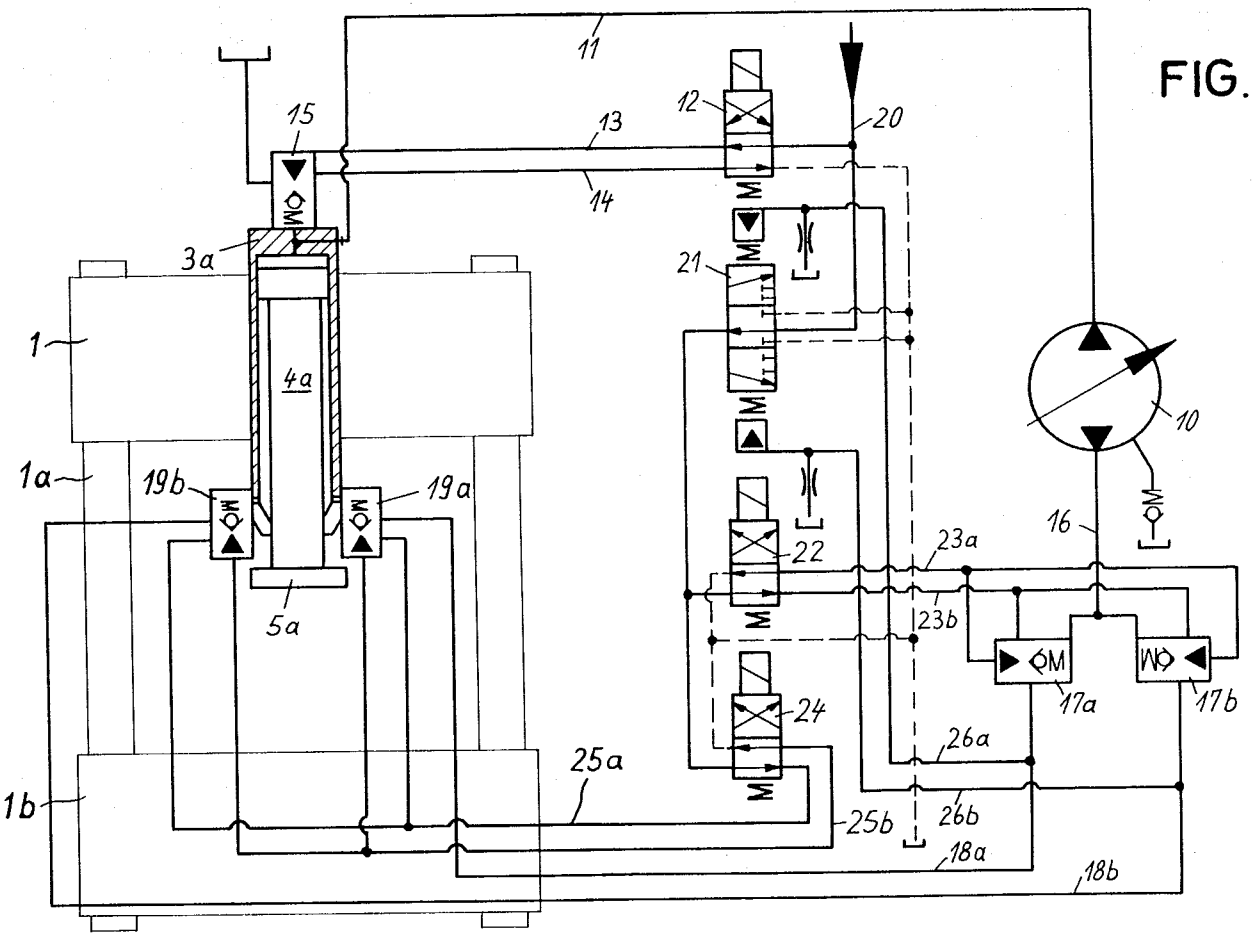
FIG. 3 is a schematic view of a hydraulic control diagram as in FIG. 1 but controlling only a single cylinder which operates as a support cylinder or lifting cylinder and which has a double-acting piston.

FIG. 3 shows a similar hydraulic circuit applied to a double-acting piston 4*a* of a working cylinder or lifting cylinder 3*a*, for example in a vertical forming press. At its underside the piston 4*a* comprises for example a ram 5*a*.

The drive of the piston 4*a* is effected by a controllable hydraulic pump 10 by way of working pressure pipe 11. Upon retraction of the piston 4*a*, a controlled non-return valve 15 at the cylinder 3*a* is opened by way of a magnetic valve 12 and control pipes 13, 14, so that the hydraulic liquid in the cylinder 3*a* can flow off into a pressure-free liquid tank.

For withdrawal of the piston 4*a* with ram 5*a* into its starting position, the annular lower face of the piston 4*a* is loaded with pressure liquid at working pressure produced by the hydraulic pump 10, through pipe 16, two controlled non-return valves 17*a*, 17*b*, two further working pressure pipes 18*a* and 18*b* in parallel, and two further controlled non-return valves 19*a* ann 19*b* at the cylinder 3*a*.

Lifting of the ram 5*a*, or the withdrawal thereof to its starting postion, occurs in the same manner as the lifting or withdrawal of the ram 5 in FIG. 1. Since the relative functioning of the individual valves and pipes is the same in FIG. 1 and FIG. 3, in the following description references to the constructional elements shown in FIG. 3, such as cylinder 3*a*, piston 4*a*, and ram 5*a* are given in brackets behind references to the corresponding parts of FIG. 1.

For lifting the ram 5 (5*a*), or retracting it to its starting position, the two controlled non-return valves 17*a* and 17*b* which, in the working pressure flow, follow the hydraulic pump 10, are opened by application of a control pressure to the non-return valves 17*a* and 17*b* through a pipe 20, a 4/3-way valve 21 which is held hydraulically in the center position, an electrically controlled 4/2 way valve 22, and, when the valve 22 is switched electrically, a control pipe 23*a*. In the normal rest position of the valve 22, the control pressure is applied from this valve through a control pipe 23*b* to the non-return valves 17*a* and 17*b*, and maintains these closed.

During lowering of the ram 5 or for the pressing process, the controlled non-return valves 19*a* and 19*b* at the withdrawal cylinders 9 (cylinder 3*a*) are opened by the application of control pressure through the pipe 20, the valve 21, a further electrically controlled 4/2 way valve 24 and, when valve 24 is electrically switched, a control pipe 25*b*. In the normal rest position of the valve 24 the control pressure is supplied from this valve through a control pipe 25*a* to the non-return valves 19*a* and 19*b* to maintain these closed.

The valve 21 is normally maintained in the center position by hydraulically controlled pilot valves arranged at its two ends. Respective branch pipes 26*a* and 26*b* lead from the working pressure pipes 18*a*, 18*b* respectively located between the controlled non-return valves 17*a*, 17*b* and 19*a*, 19*b* to the pilot valves of the valve 21.

For the withdrawal to its starting position of the ram 5 (5*a*) the valve 22 must first be electrically actuated, so that the control pressure is applied through the pipe 23*a* to the controlled non-return valves 17*a* and 17*b* and opens these for the application of the working pressure from the hydraulic pump 10 through pipes 18*a* and 18*b* to the withdrawal cylinders 9 of the press. If for example, during this withdrawal process a fracture or leakage should occur in the working pressure pipe 18*a*, the working pressure in the branch pipe 26*a* will drop. Consequently an imbalance is established at the valve 21 in consequence of the pressure difference between the two branch pipes 26*a* and 26*b*. The pressure which is then higher in the branch pipe 26*b* switches the valve 21 and cuts off the control pressure hydraulically and connects the control pipe 23*a* to the tank.

In consequence of the absence of control pressure from the controlled non-return valves 17*a* and 17*b*, the latter are closed and the working pressure to the pipes 18*a* and 18*b* is cut off. Since the non-return valves 19*a* and 19*b* at the withdrawal cylinders 9 (cylinder 3*a*) are not loaded by control pressure during the withdrawal they close automatically when working pressure is absent, so that the load, in the case of FIG. 1, the ram 5 with main press plunger 4, retraction rods 6, cross-members 7 and retraction pistons 8, is maintained in the position just assumed at the instant of a fracture of the working pressure pipe 18*a*; in the case of FIG. 3 the ram 5*a* with piston 4*a* is maintained in the position which it has just assumed at the instant of a fracture of the working pressure pipe 18*a*. A fracture of the pipe 18*b* has similar effects.

During lowering of the ram 5 (5*a*) for example for pressing a workpiece, fluid is supplied under pressure via the pipe 11 and the valve 24 is electrically actuated so that the control pressure is applied through the pipe 25*b* to the controlled non-return valves 19*a* and 19*b* and opens these valves to allow the pressure medium to be returned by way of pipes 18*a* and 18*b* and the non-return valves 17*a* and 17*b* to the pump 10. If, for example, during this lowering a fracture or leakage should occur in the working pressure pipe 18*a*, the working pressure in the branch pipe 26*a* will drop. Consequently an imbalance is established at the valve 21 in consequence of the pressure difference between the two branch pipes 26*a* and 26*b*. The pressure which is then higher in the branch 26*b* switches the valve 21 and cuts off the control pressure hydraulically and connects the control pipe 25*a* to the tank. In the absence of control pressure from the controlled non-return valves 19*a* and 19*b*, the latter are closed preventing the further descent of the ram 5 (5*a*). Once again, the ram and its piston are maintained in the position which was assumed at the instant of fracture and spillage of working fluid is prevented. A fracture of the pipe 18*b* has similar effects.

Figure 2:
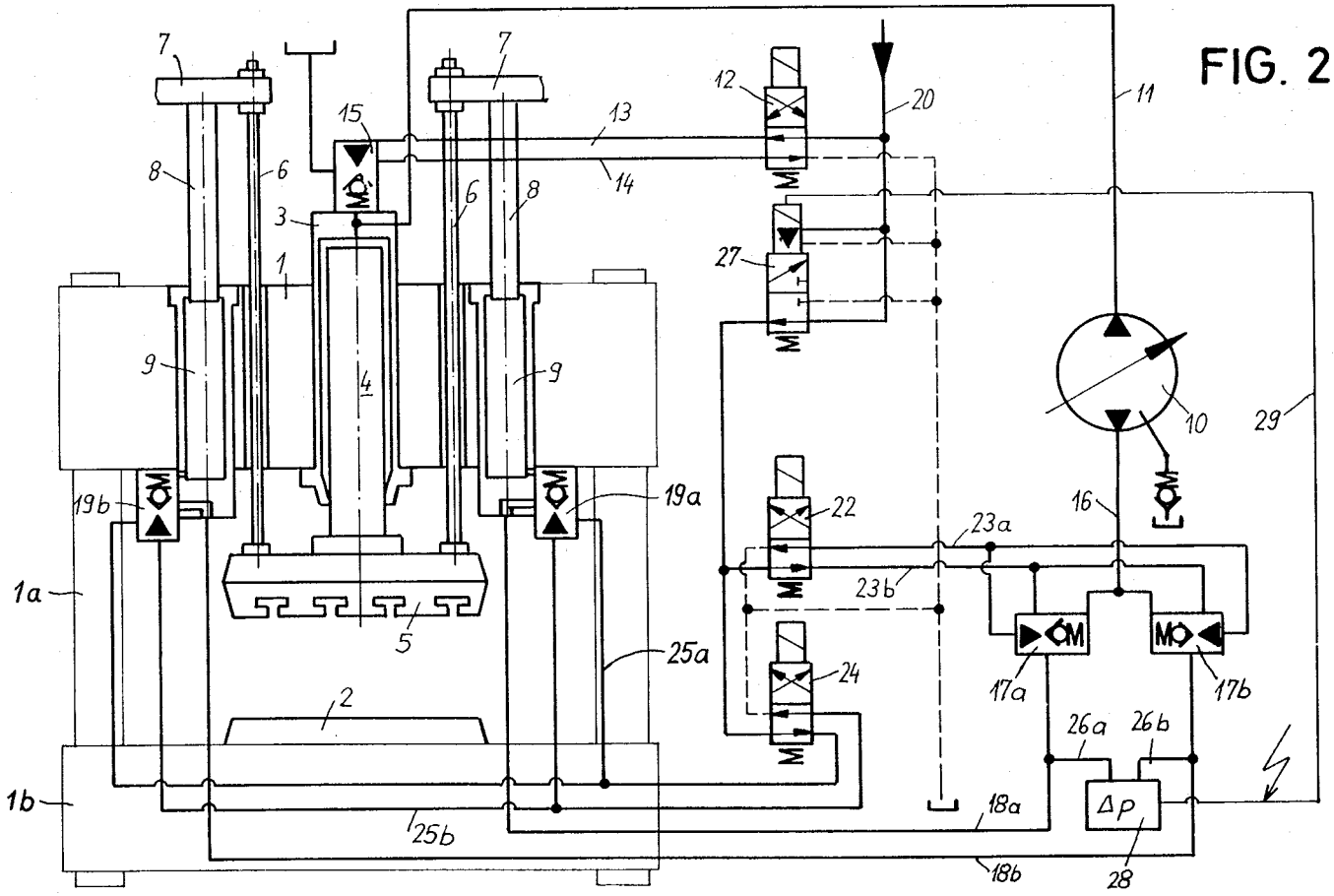
FIG. 2 is a schematic view showing a similar arrangement but with a directional control valve which is electro-hydraulically controlled by way of a pressure difference sensor.

FIG. 2 illustrates the same press as FIG. 1. The control circuit is in general the same as FIG. 1, but the 4/3 way direction control valve 21 illustrated in FIG. 1 is replaced in FIG. 2 by a 3/2 way valve 27 which is controlled electro-hydraulically, i.e. a magnet pilot valve controls hydraulically the 3/2-way valve 27, which is maintained in the normal position by spring pressure.

Furthermore, in FIG. 2 respective branch pipes lead from the working pressure pipes 18*a* and 18*b* directly to a differential pressure transducer 28. If a pressure difference occurs between the two branch pipes 26*a* and 26*b*, or between the working pressure pipes 18*a* and 18*b*, the transducer 28 operates the magnetic pilot valve of the valve 27 by way of an electrical lead 29, whereby the valve 27 is actuated to cut off the control pressure supplied through the valves 22 and 24 to the controlled non-return valves 17*a* and 17*b*, and 19*a* and 19*b* respectively.

Thereby, in the same manner as in the arrangement according to FIG. 1, sudden dropping of the load upon fracture of one of the working pressure pipes 18*a* or 18*b* is avoided, as likewise the unimpeded spillage of working pressure liquid, which could lead to a risk of an accident and soiling of the environment.

Figure 4:
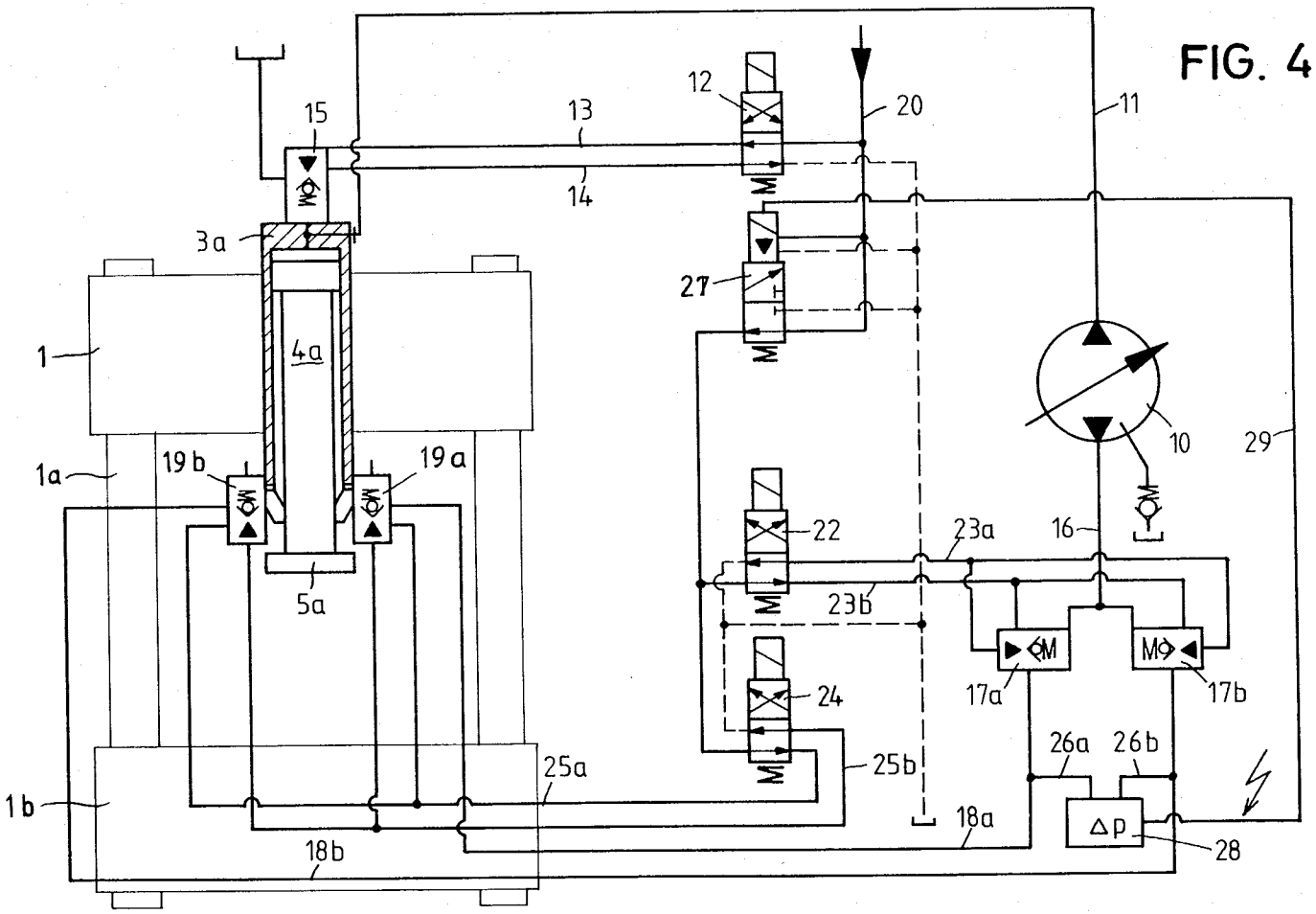
FIG. 4 is a schematic view showing an arrangement similar to FIG. 3, but with a directional control valve which is electro-hydraulically controlled by means of a pressure difference sensor.

The statements in respect of FIG. 2 apply to FIG. 4 in the same manner, since FIG. 4 shows the same control circuit as FIG. 2, applied however to a double-acting piston and cylinder 3*a*, 4*a*, 5*a*.

We claim:

1. A safety control device for preventing uncontrolled movement of a load-supporting hydraulic cylinder, comprising: a source of working pressure; two working pressure supply pipes connecting said source of working pressure to said cylinder; two controlled non-return valves in each working pressure supply pipe, one of said valves in each pipe being associated with said cylinder and the other valve in each pipe being closer to said source; a pressure difference sensor operatively connected to said supply pipes to indirectly control said valves to close said valves is response to a pressure difference between said supply pipes; a directional control valve which is electrohydraulically maintained in its rest position and which is controlled in a pressure difference dependent manner by means of said sensor; and two branch pipes connected to said sensor for electrically switching the directional control valve, each branch pipe being connected to a respective working pressure pipe at a point between said controlled non-return valve closer to said source of working pressure and said non-return valve associated with the cylinder.

2. A safety control device as claimed in claim 1 wherein said pressure difference sensor comprises an electrical transducer.

3. A safety control device for preventing uncontrolled movement of a pair of parallel-acting load-supporting hydraulic cylinders, comprising: a source of working pressure; a separate working pressure supply line connecting said source of working pressure to a respective one of said pair of cylinders; at least one fluid-pressure controlled valve in each working pressure supply line disposed at or adjacent to each cylinder for preventing outflow of hydraulic fluid from each cylinder; a directional control valve connected in controlling fluid relation to said valves in said supply lines and responsive to a pressure difference between said supply lines, said directional control valve having a normal position in which said controlled valves are open, and having a pair of substantially symmetrical hydraulically actuated means each connected to a respective one of said supply lines so that when the respective pressures in said supply lines are equal said directional control valve is hydraulically balanced in its normal position, and on occurrence of said pressure difference said hydraulically actuated means displaces said directional control valve to a position effecting closure of said valves in said supply lines.

4. A device according to claim 3 and further comprising at least one further said valve in each said supply line disposed adjacent to the source of said working pressure, each said further valve being a fluid-pressure-controlled valve in controlled fluid relation to said directional control valve so that said further valves are closed by operation of said directional control valve on occurrence of said pressure difference.

5. A safety control device for preventing uncontrolled movement of at least two load supporting hydraulic cylinders, comprising: a source of working pressure; two working pressure supply pipes connecting said source of working pressure to each of said at least two cylinders; two controlled non-return valves for each cylinder in each supply pipe which are controlled indirectly in dependence on pressure difference between said supply pipes; a directional control valve which is maintained hydraulically in equilibrium in a center position and which is controlled directly in dependence on pressure difference between said supply pipes; and respective branch pipes connecting said directional control valve to respective ones of said working pressure pipes at points between the respective two controlled non-return valves so that said directional control valve closes said controlled non-return valves in response to said pressure difference between said supply pipes.

6. A safety control device for preventing uncontrolled movement of at least two load-supporting hydraulic cylinders, comprising: a source of working pressure; a separate working pressure supply pipe connecting said source of working pressure to each cylinder; two controlled non-return valves in each supply pipe; a pressure difference sensor responsive to a pressure difference between said supply pipes, said non-return valves being controlled indirectly in a pressure difference dependent manner by said pressure difference sensor; a directional control valve which is maintained electro-hydraulically in a rest position and which is electrically controlled in a pressure difference dependent manner by said pressure difference sensor; and two branch pipes each connected at one end to said sensor and at the other end to a respective working pressure supply pipe between said controlled non-return valves in each supply pipe, so that said directional control valve operates to close said non-return valves in response to said pressure difference between said supply pipes.

7. A safety control device according to claim 6 wherein said pressure difference sensor comprises an electrical transducer.

8. A safety control device for preventing uncontrolled movement of a pair of parallel-acting load-supporting hydraulic cylinders, comprising: a source of working pressure; a separate working pressure supply line connecting said source of working pressure to a respective one of said pair of cylinders; at least one fluid-pressure controlled valve in each working pressure supply line; a directional control valve connected in controlling fluid relation to said valves in said supply lines and responsive to a pressure difference between said supply lines, said directional control valve having a normal position in which said controlled valves are open, and having a pair of substantially symmetrical hydraulically actuated means each connected to a respective one of said supply lines so that when the respective pressures in said supply lines are equal said directional control valve is hydraulically balanced in its normal position, and on occurrence of said pressure difference said hydraulically actuated means displaces said directional control valve to a position effecting closure of said valves in said supply lines.

9. A safety control device for preventing uncontrolled movement of a load-supporting hydraulic cylinder, comprising:

a source of working pressure;

two working pressure pipes connecting said source or working pressure to said cylinder;

sensing means comprising a directional control valve which is hydraulically maintained in equilibrium in its center position and which is directly controlled by a pressure difference between said supply lines;

for each said working pressure pipe two controlled non-return valves which are indirectly controlled in a pressure difference dependent manner by said sensing means, one said valve being associated with the cylinder and the other said valve being closer to said source;

and respective branch pipes controlling said directional control valve connected to said working pressure pipes at respective points each between the respective said one non-return valve associated with the cylinder and said other non-return valve closer to the source;

said sensing means being connected to close said valves in response to occurrence of a pressure difference between said supply lines, each said one valve being cooperatively associated with said cylinder so that said closing of each one valve by said sensing means prevents movement of said cylinder.

* * * * *